US008836597B1

(12) United States Patent
Vizzio et al.

(10) Patent No.: US 8,836,597 B1
(45) Date of Patent: Sep. 16, 2014

(54) MOTOR CONTROLLED ROTATING BASE FOR DIRECTIONAL SUBMARINE ANTENNAS

(71) Applicants: Paul J. Vizzio, Boston, MA (US); David J. Bamford, Wakefield, RI (US); Douglas A. Sasko, North Stonington, CT (US)

(72) Inventors: Paul J. Vizzio, Boston, MA (US); David J. Bamford, Wakefield, RI (US); Douglas A. Sasko, North Stonington, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 221 days.

(21) Appl. No.: 13/630,717

(22) Filed: Sep. 28, 2012

(51) Int. Cl.
*H01Q 3/00* (2006.01)

(52) U.S. Cl.
USPC ..... 343/757; 343/765; 343/872; 343/882

(58) Field of Classification Search
USPC ..... 343/757, 765, 872, 882
See application file for complete search history.

(56) References Cited

U.S. PATENT DOCUMENTS

| | | | | | |
|---|---|---|---|---|---|
| 3,040,318 | A * | 6/1962 | Lang et al. | ..... | 343/760 |
| 3,893,123 | A * | 7/1975 | Bieser | ..... | 343/706 |
| 3,911,441 | A * | 10/1975 | Stein | ..... | 343/709 |
| 4,920,350 | A * | 4/1990 | McGuire et al. | ..... | 343/709 |
| 5,432,524 | A * | 7/1995 | Sydor | ..... | 343/765 |
| 6,861,994 | B2 * | 3/2005 | Desargant et al. | ..... | 343/765 |
| 7,636,068 | B2 * | 12/2009 | Duk-Yong | ..... | 343/766 |
| 7,683,845 | B2 * | 3/2010 | Wynn | ..... | 343/757 |

* cited by examiner

*Primary Examiner* — Tho G Phan
(74) *Attorney, Agent, or Firm* — James M. Kasischke; Jean-Paul A. Nasser; Michael P. Stanley

(57) ABSTRACT

An antenna radome assembly has a radome base and an annular stationary bearing plate attached to and spaced from the radome base. A rotary joint has a fixed portion attached to the stationary bearing plate and a rotating portion extending through a central opening of the stationary bearing plate. A rotating platform is attached to the rotating portion of the rotary joint. The rotating platform includes a circular recess extending into the rotating platform from a first side. The stationary bearing plate is disposed completely within the circular recess. An annular bearing assembly is disposed within the circular recess between the rotating platform and the stationary bearing plate. The bearing assembly is in contact with the rotating platform and the stationary bearing plate, and the rotating platform rotates with respect to the stationary bearing plate and the radome base.

20 Claims, 7 Drawing Sheets

MOTOR CONTROLLED ROTATING BASE FOR DIRECTIONAL SUBMARINE ANTENNAS

STATEMENT OF GOVERNMENT INTEREST

The invention described herein may be manufactured and used by or for the Government of the United States of America for Governmental purposes without the payment of any royalties thereon or therefore.

BACKGROUND OF INVENTION

1) Field of the Invention

The present invention is directed to directional antennas and antenna radomes.

2) Description of Prior Art

The range of an antenna is based on its power divided by its beam width, among other variables. Therefore, directional antennas operate at greater ranges than omni antennas of the same power, since directional antennas focus their beam width on an area and omni antennas do not restrict their beam width. The problem with directional antennas is that to see in all directions, these antennas either have to rotate or multiple antennas need to be used.

Two exemplary submarine antenna systems that utilize a rotating directional antenna are the Submarine High Data Rate (SubHDR) and the Type 8B/J Mod 3. However, neither antenna fits inside a 4.75" inner diameter (ID) submarine radome. SubHDR is a three-axis satellite communication (SATCOM) system that features a rotating directional antenna that fits in a very large enclosure (radome) that includes a half of a sphere of radius two feet sitting on top of a two foot diameter cylinder of height one foot that is on top of a one foot tall tapered cone. SubHDR, while utilizing a rotating antenna, is extremely large. Larger systems are easier to detect visually and by radar.

The Type 8B/J Mod 3 is similar to SubHDR in that it is a three-axis SATCOM system, but it fits inside a much smaller radome with an outside diameter of 7.5". Antenna systems that have been used in 4.75" ID submarine radomes have been non-rotating. These systems have either utilized omni-directional antennas (one antenna that transmits/receives in all directions) or an array containing more than one directional antenna. Using multiple antennas creates two disadvantages, spreading power among multiple antennas and requiring a larger enclosure to house the antennas. Using multiple antennas means that the power supplied to the system is split between each individual antenna, and therefore the range of the entire system is based on the power divided by the number of antennas used. Using multiple antennas also creates size constraints because the size taken up is always going to be larger that of one antenna. Therefore, a single directional antenna is desired that can be rotated as needed and can be contained within a smaller radome.

SUMMARY OF THE INVENTION

Exemplary embodiments in accordance with the present invention are directed to an antenna radome assembly having a radome base and an annular stationary bearing plate attached to and spaced from the radome base. A dual channel rotary joint is included in the assembly and is constructed from a fixed portion that is attached to the stationary bearing plate and a rotating portion extending through a central opening of the stationary bearing plate. The rotating portion includes a pair of connection terminals, one terminal for each channel. The connection terminals are accessible from a second side of the rotating platform opposite the first side.

A rotating platform is attached to the rotating portion and is rotatable with the rotating portion of the rotary joint. The rotating platform includes a circular recess extending into the rotating platform from a first side. The stationary bearing plate is disposed completely within the circular recess. An annular bearing assembly is also disposed within the circular recess between the rotating platform and the stationary bearing plate. The bearing assembly is in contact with the rotation platform and the stationary bearing plate and the rotating platform rotates with respect to the stationary bearing plate and the radome base.

A radome is attached to the radome base to cover the stationary bearing plate and the rotating platform. A directional antenna is attached to the second side of the rotating platform opposite the first side and is covered by the radome. The directional antenna includes two co-axial connections. Each co-axial connection is attached to one of the connection terminals in the rotary joint. The directional antenna extends from the second side of the rotating platform a distance of less than about 5.5 inches.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Figure 1:
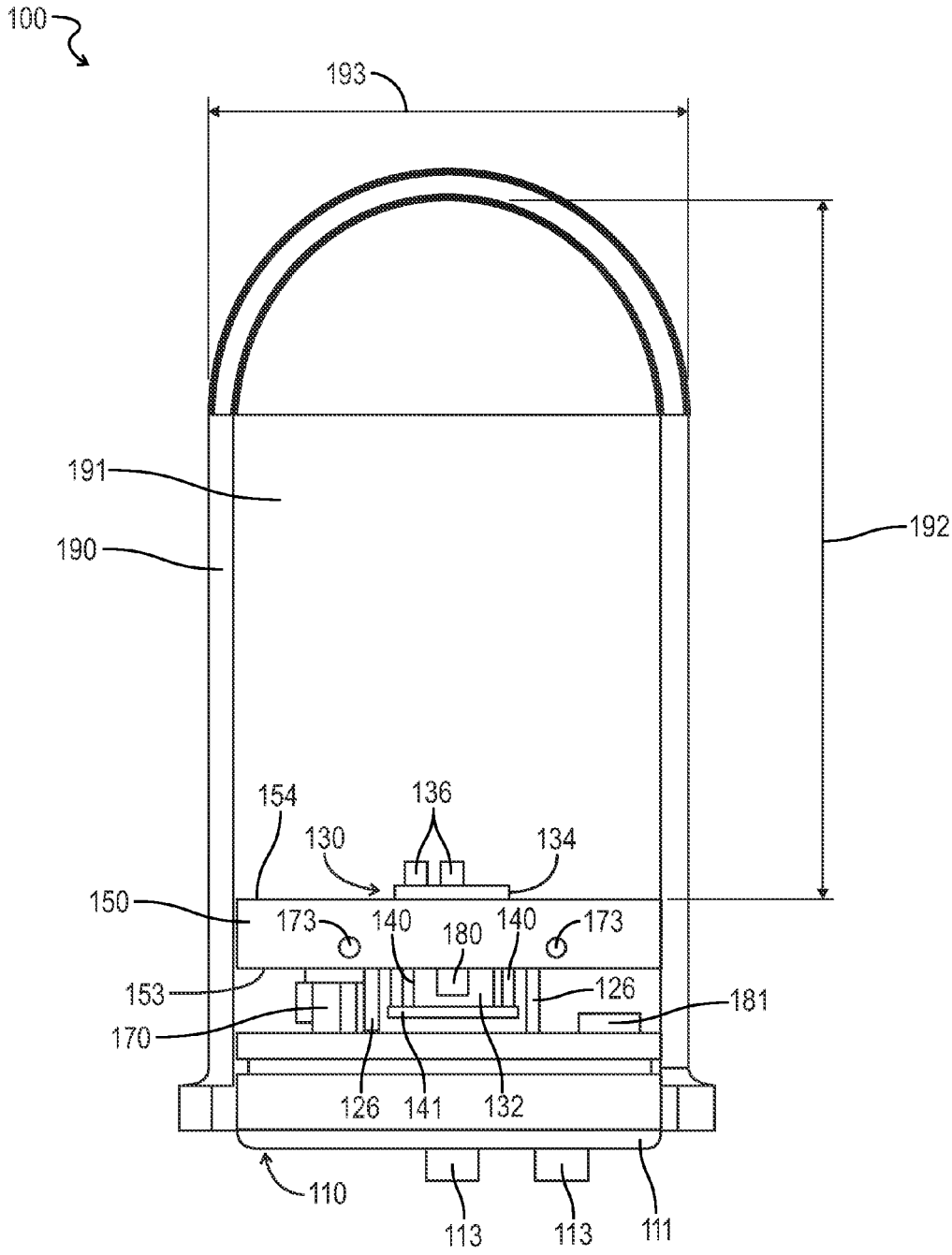
FIG. 1 is a representation of an embodiment of the antenna radome assembly in accordance with the present invention.

Referring initially to FIG. 1, exemplary embodiments in accordance with the present invention are directed to an antenna radome assembly 100 rotationally positional deployment of a single directional antenna (not shown) in a compact radome enclosure that is attached to vehicles such as surface water vehicles and underwater vehicles including unmanned undersea vehicles (UUVs). In general, the antenna radome assembly 100 is constructed from a plurality of sub-assemblies including a base assembly, a stationary stand, a bearing assembly, a rotating platform, a motor drive, a positioning assembly, an antenna system, and a radome.

Figure 3:
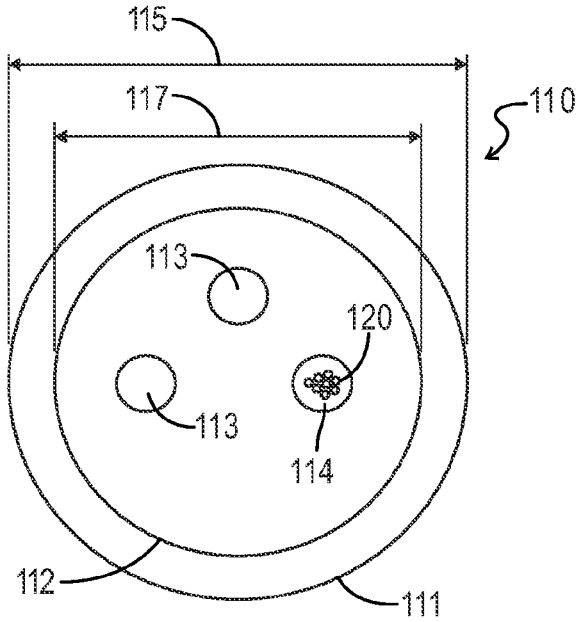
FIG. 3 is a top view of an embodiment of the radome base for use in the antenna radome assembly.
Figure 4:
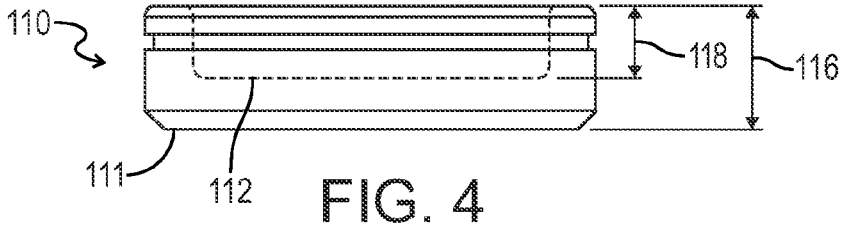
FIG. 4 is a side view an embodiment of the radome base for use in the antenna radome assembly.
Figure 5:
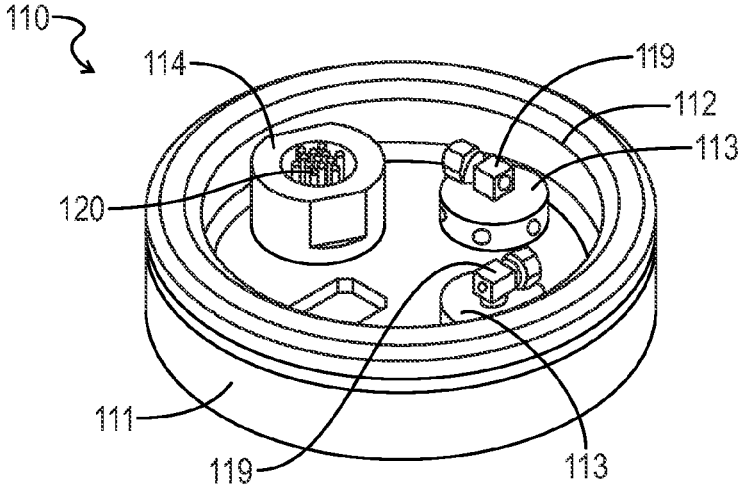
FIG. 5 is a perspective view an embodiment of the radome base for use in the antenna radome assembly.

Referring to FIGS. 3-5, the base assembly 110 includes a radome base 111. A pair of radome base co-axial cable connectors 113, e.g., two RF connectors, and a multiple pin connector 114 are attached to the radome base.

In general, the radome base 111 is a disc having a circular cavity 112 extending into the disc from one side. In one embodiment, this disc has a diameter 115 of less than about 4.75 inches and a thickness 116 of about 1.3 inches. The circular cavity 112 has a diameter 117 of less than about 3.75 inches and a depth 118 of about 0.75 inches. Suitable materials for the radome base 111 include, but are not limited to, stainless steel. Preferably, the radome base co-axial cable connectors 113 and multiple pin connector 114 are disposed completely within the circular cavity 112 such that the co-axial cable connectors and multiple pin connector do not extend above the circular cavity.

In one embodiment, the two radome base co-axial cable connectors 113 are modified versions of D. G. O'Brien connector #1100 011-101, commercially available from Teledyne D. G. O'Brien, Inc. of Seabrook, N.H., USA. In order to reduce the size of the antenna radome assembly 100, the D. G. O'Brien connector is modified such that the blind mate connector is cut down and replaced with a 90° SubMinature version A (SMA) coaxial RF connector 119. These 90° connectors are arranged perpendicular to the direction in which the co-axial cable connectors 113 pass through the radome base 111.

The multiple pin connector 114 is also modified. In one embodiment, the multiple pin connector 114 is a modified Seacon-XSEE-12#20-BCR connector, commercially available from SEA CON® of El Cajon, Calif., USA. In the modified multiple pin connector 114, a threaded portion that would be located inside the circular cavity 112 of the radome base 111 is removed, and the resulting overall length or size is smaller and wires can be easily attached to the pins 120. In one embodiment, the two co-axial cable connectors 113 and the multiple pin connector 114 screw into the radome base.

Figure 2:
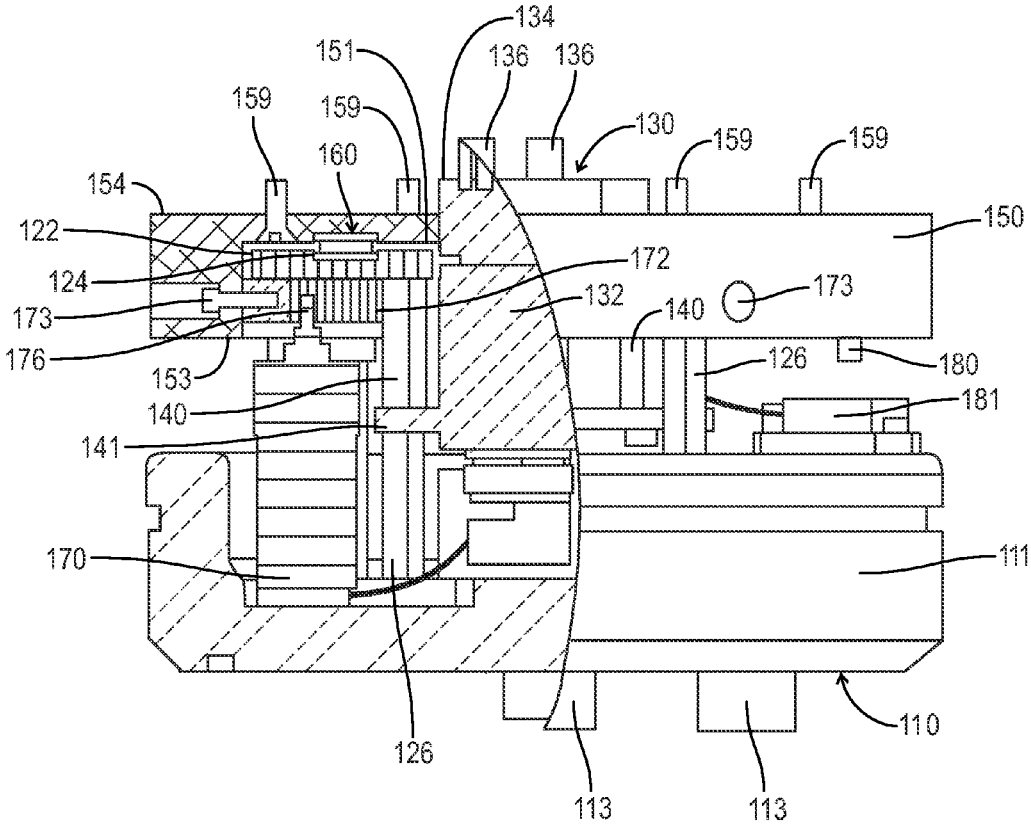
FIG. 2 is a partial cut-away view of an embodiment of the side of the radome base, stationary platform and rotating platform assemblies of the antenna radome assembly.
Figure 6:
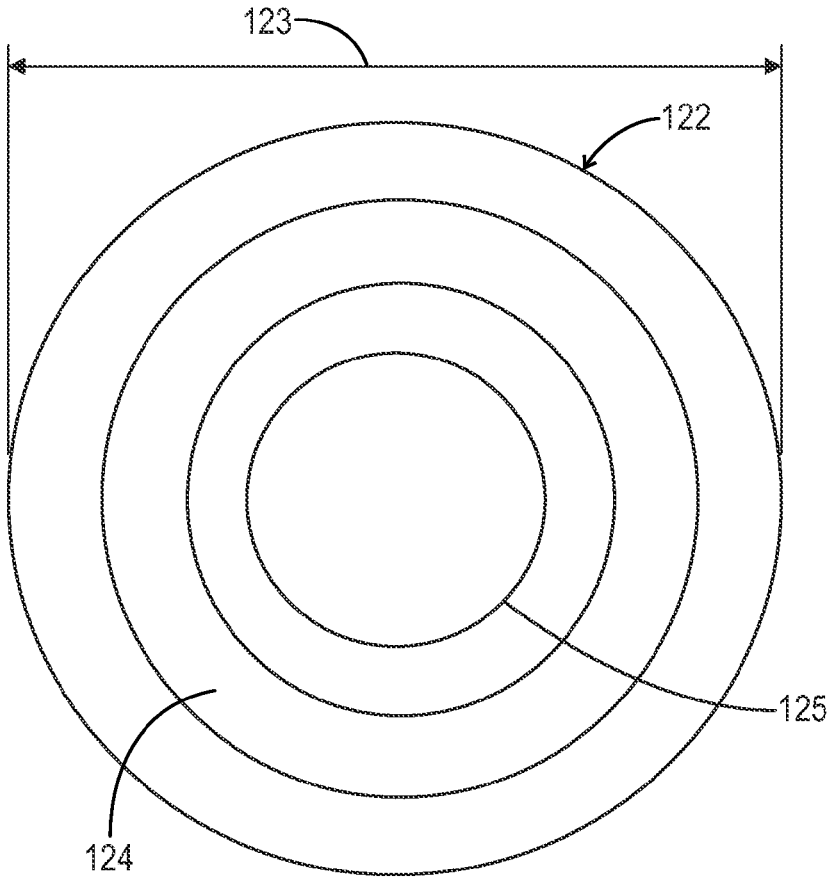
FIG. 6 is a top view of an embodiment of a stationary bearing plate for use in the antenna radome assembly.
Figure 7:
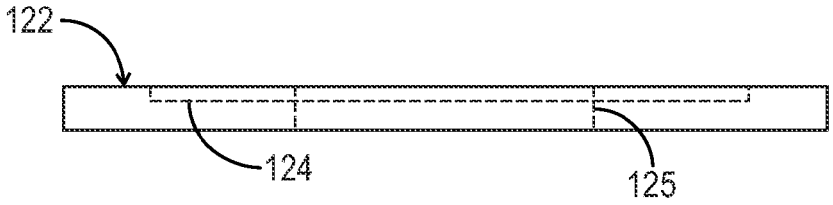
FIG. 7 is a side view of an embodiment of a stationary bearing plate for use in the antenna radome assembly.

Referring to FIGS. 2 and 6-7, the stationary stand is an assembly that includes an annular stationary bearing plate 122 that is attached to and spaced from the radome base 111. The stationary bearing plate 122 is the main support and functions as the static piece about which the directional antenna rotates. Suitable materials for the stationary bearing plate include, but are not limited to, aluminum. In one embodiment, the stationary bearing plate has a diameter 123 of about 3.5 inches and includes a central opening or aperture 125 and a concentric surface annular groove 124.

In order to attach the stationary bearing plate 122 to the radome base 111, the stationary stand portion of the assembly includes a plurality of stationary bearing plate supports 126 (FIGS. 1 and 2). Each support 126 is attached to and extends between the stationary bearing plate 122 and the radome base 111 to space the stationary bearing plate from the radome base. Preferably, the assembly includes four stationary bearing plate supports 126. Suitable materials for the stationary bearing plate supports include, but are not limited to, aluminum.

Each stationary bearing plate support 126 can either be a standoff or a machined rod with threaded rods inserted at one end. In one embodiment, each stationary bearing plate support 126 is about ¼" in diameter with two flat sides to aid in assembly and is about 1.8 inches long. The rod has a #4-40 threaded section at one end of length less than about 0.2 inches from the bottom face and the other end has a tapped #4-40 hole with a depth of about ¼". The rods are threaded into corresponding holes on the radome base 111, and the stationary bearing plate 122 is fastened to each stationary bearing plate support 126 by four #4-40×¼" countersunk cap screws.

Figure 8:
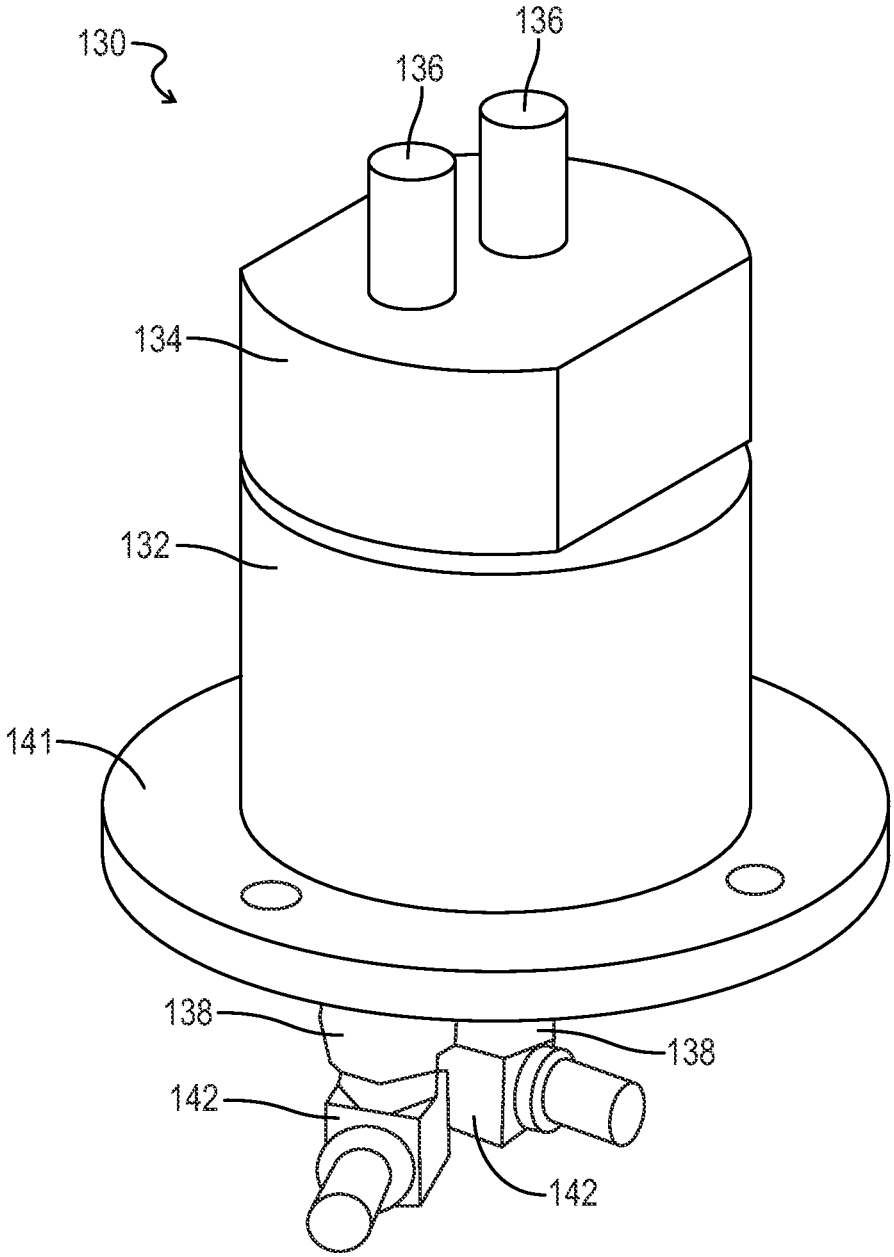
FIG. 8 is a perspective view of an embodiment of a rotary joint for use in the antenna radome assembly.
Figure 9:
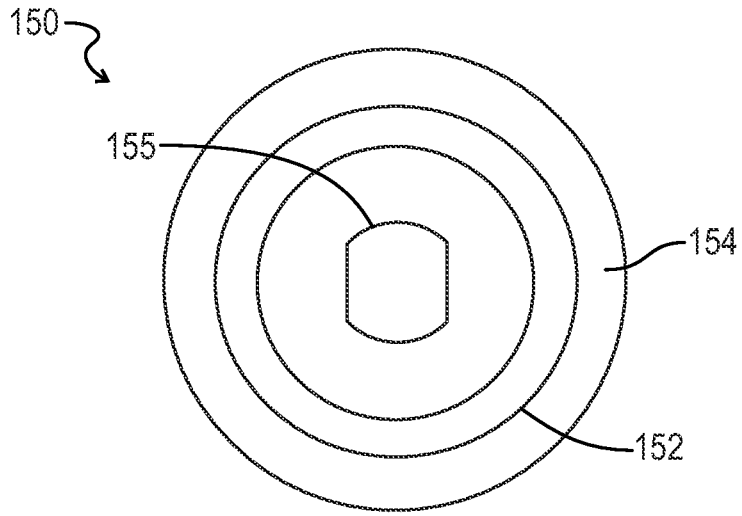
FIG. 9 is an exploded perspective view of an embodiment of a bearing assembly for use in the antenna radome assembly.
Figure 10:
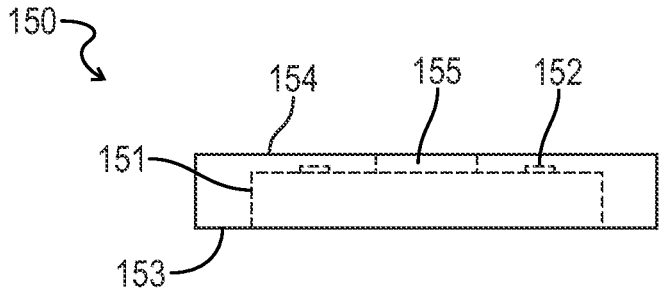
FIG. 10 is a top view of an embodiment of a rotating platform for use in the antenna radome assembly.

Referring to FIGS. 1, 2 and 8, the stationary stand also includes a rotary joint 130. The rotary joint includes a fixed portion 132 that is attached to the stationary bearing plate and a rotating portion 134 that is rotatably engaged with the fixed portion and extends through the central opening 125 of the stationary bearing plate 122. Preferably, the rotary joint 130 is a dual channel rotary joint.

For the dual channel rotary joint 130, the rotating portion includes a pair of connection terminals 136, one for each channel. In one embodiment, the rotating portion of the rotary joint 130 is formed as a male portion of a two-part keyed connection. The fixed portion includes a pair of rotary joint co-axial cable connectors 138 in communication with the pair of connection terminals 136 and the pair of radome base co-axial cable connectors 113.

In order to attached and to secure the rotary joint 130 to the stationary bearing plate 122, the stationary stand portion of the assembly further includes a plurality of rotary joint supports 140 attached to and extending between the stationary bearing plate 122 and the fixed portion 132 of the rotary joint 130 such that the rotary joint 130 is suspended by the stationary bearing plate and the fixed portion 132 extends towards the radome base 111 and is spaced from the radome base 111, i.e., the fixed portion 132 does not extend the entire distance from the stationary bearing plate 122 to the radome base 111. In order to facilitate the attachment of the rotary joint supports 140 to the fixed portion 132, the fixed portion includes a circular flange 141 running completely around the circumference of the fixed portion 132.

Each rotary joint support 140 is similar in materials and configuration to the stationary bearing plate supports 126. However, the lengths of the rotary joint supports 140 are shorter. In one embodiment, the assembly includes four rotary joint supports that are ¼" diameter rods with two flat sides and are about 0.78" long. The rotary joint supports 140 have a #4-40 tapped hole at each end of depth ¼". The supports are screwed to the stationary bearing plate 122 via four #4-40×¼"countersunk screws and are screwed at the other end to the rotary joint via four #4-40×¼" cap screws.

In general, the dual channel rotary joint 130 is used to connect the radome base co-axial cable connectors 113 to the rotating directional antenna system that includes, for example, the directional antenna and a GPS unit. These connections are made using co-axial cables. In order to reduce the space requirements, two 90° SubMinature version A (SMA) coaxial RF connectors 142 are connected to the two SMA ports 138 that extend from the fixed portion 132 of the rotary joint 130. The coaxial cables, e.g., two 0.141 coaxial cables, are connected between these two 90° connectors 142 on the rotary joint and to the radome base co-axial cable connectors 113. Without a rotary joint, continuous rotations of the directional antenna would result in the wrapping and twisting of the coaxial cables. Suitable rotary joints are commercially available from the Kevlin Corporation of Methuen, Mass.

Referring to FIGS. 1, 2, 9 and 10, the assembly includes a rotating platform 150 that is attached to and rotatable with the rotating portion 134 of the rotary joint 130. The rotating platform 150 includes a circular recess 151 extending into the rotating platform 150 from a first side 153. The annular stationary bearing plate 122 is disposed completely within the circular recess 151 and is preferably arranged concentric with the circular recess 151 and spaced from the rotating platform 150 and the interior surfaces of the circular recess 151 so that the rotating platform 150 can rotate freely with respect to the stationary bearing plate 122.

In one embodiment, attachment of the rotating portion 130 to the rotating platform 150 and mutual, coordinated rotation is provided by a central keyhole 155 disposed in the circular recess 151 of the rotating platform 150. The circular keyhole extends through the rotating platform to a second side 154 opposite the first side 153. The keyhole is configured as the female portion of the two-part keyed connection. The corresponding male portion found on the rotating portion 134 extends into the keyhole to attach the rotating portion to the rotating platform. Therefore, the connection terminals 136 of the rotary joint 130 are accessible from the second side of the rotating platform 154.

In one embodiment, the rotating platform includes an internal annular groove 152 disposed within and concentric with the circular recess 151. The concentric surface annular groove 124 of the stationary bearing plate is disposed opposite the internal annular groove 152.

The rotating platform 150 is constructed as a single piece to which additional pieces are attached including the directional antenna. Suitable materials for the rotating platform 150 include, but are not limited to, aluminum. The rotating platform sits on top of the stationary bearing plate 122 that is positioned within the circular recess 151 and rotates relative to the stationary bearing plate 122 and the radome base 111. Directional antennas are mounted to the second side of the rotating platform using a plurality of fasteners 159 such as countersunk screws. In one embodiment, the directional antenna is secured to the second side using six #4-40×0.375" countersunk screws.

Figure 11:
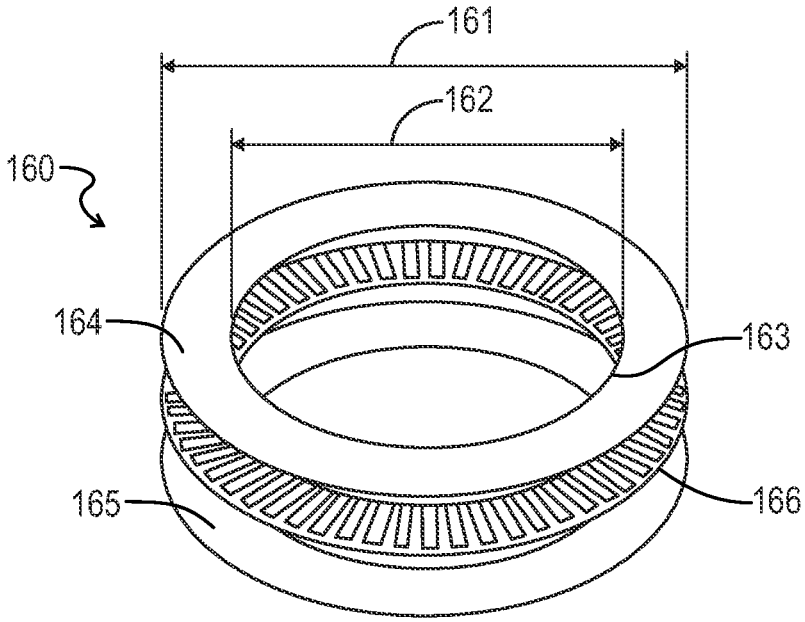
FIG. 11 is a side view of an embodiment of a rotating platform for use in the antenna radome assembly.

Referring to FIGS. 2 and 11, the assembly includes an annular bearing assembly 160 disposed within the circular recess 151 between the rotating platform 150 and the stationary bearing plate 122. The bearing assembly 160 is in contact with the rotating platform 150 and the stationary bearing plate 122 to facilitate rotation of the rotating platform with respect to the stationary bearing plate and the radome base 111. In one embodiment, the bearing assembly has a diameter 161 of less than about 2.75 inches and a central hole 163 having a diameter of about 2 inches. The bearing assembly includes a first annular bearing surface 164 in contact with the rotating platform, a second annular bearing surface 165 in contact with the stationary bearing plate and a plurality of roller bearings 166 disposed between the first annular bearing surface 164 and the second annular bearing surface 165. Suitable materials for the bearing assembly include, but are not limited to steel, such as stainless steel. The first annular bearing surface 164 rotates with respect to the second annular bearing surface 165 over the plurality of roller bearings 166. Preferably, the first annular bearing surface is disposed within the internal circular groove 125, and the second annular bearing surface is disposed within the surface annular groove 124 (FIG. 2).

Therefore, the bearing assembly 160 is configured as a three part assembly. All three parts are commercially available from McMaster-Carr of Robbinsville, N.J. The roller bearings 166 are preferably arranged as a thrust needle-roller bearing, which is part number 5909K43, and the annular bearing surfaces 164 and 165 are bearing washers, which is part number 5909K56. The bearing assembly 160 fits between the stationary bearing plate 122 and the rotating platform 150 in the appropriate annular groove. The bearing assembly 160 allows the rotating platform 150 to rotate smoothly about the stationary bearing plate 122. Washers are used because the stationary stand and the rotating platform bearing surfaces are preferably aluminum and not hard enough for the thrust bearing. These bearing surfaces would wear and degrade the performance of the system over time. The lower washer is also used to cover up recessed holes on the stationary bearing plate, which otherwise would have created a non-flat bearing surface that would accelerate wear and yield a less smooth rotation.

Figure 12:
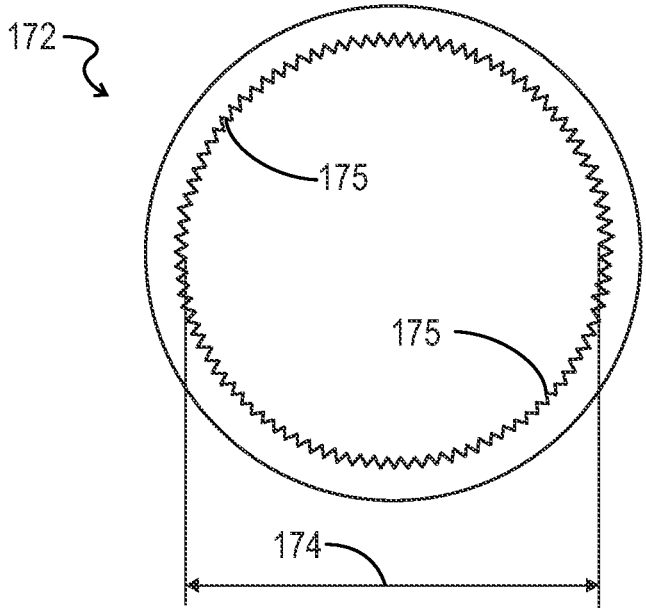
FIG. 12 is a top view of an embodiment of an internal gear for use in the antenna radome assembly.

In order to rotate the rotating platform 150 and the directional antenna attached to the rotating platform, the assembly of the present invention also includes a motor drive assembly. Referring to FIGS. 1, 2 and 12, this drive assembly includes an internal gear 172 disposed in the circular recess 151 such that the stationary bearing plate is spaced from the internal gear and is disposed between the internal gear and the rotating platform 150 to secure the stationary bearing plate 122 in the circular recess 151.

Suitable internal gears are commercially available from Stock Drive Products/Sterling Instrument of New Hyde Park, N.Y. and include, for example, part number S1E082M08S096. As necessary, the internal gear is modified to fit inside the circular recess 151 of the rotating platform 150 and is secured using six radial screws 173, e.g., #2-56×¼" cap screws. The internal gear 172 is fastened to the rotating platform 150 after the rotating platform has been placed on top of the stationary bearing plate 122 and the internal gear 172 sits under the stationary bearing plate and constrains the system vertically. The inside diameter 174 of the internal gear is smaller than the outside diameter 123 of the stationary bearing plate 122. Therefore, the rotating platform 150 cannot be lifted off of the stationary bearing plate 122 unless the internal gear 172 is removed from the circular recess 151 of the rotating platform 150. There is a clearance between the bottom face of the stationary stand and the top face of the gear so that the whole assembly can move freely.

The assembly includes a motor 170 attached to the radome base 111 and disposed between the radome base and the internal gear 172. A pinion gear 176 is provided that is attached to and rotatable by the motor. The pinion gear 176 engages gear teeth 175 disposed in the internal gear 172 to rotate the rotating platform 150 relative to the radome base 11 and the stationary bearing plate 122. Suitable pinion gears are commercially available from Stock Drive Products/Sterling Instrument of New Hyde Park, N.Y., for example as part number A 1B 1MY08006. Suitable materials for the pinion gear 176 include, but are not limited to, brass. The pinion gear is fastened to the motor 170 by a pin or solder or any other appropriate adhesive or bonding material. The pinion gear turns 176 the internal steel gear 172 that is attached to the rotating platform 150.

Suitable motors include, but are not limited to, a brushless DC motor that contains a relative encoder, for positioning, and a spur gear head that creates a 22:1 gear ratio. Suitable motors are commercially available from Micro Mo of Clearwater, Fla. as, for example, part number 1524-012SR/16A-22:1/IE2-512. This motor has 6 input/output wires and that are attached to the corresponding pins 120 on the pin connector 114 that is fastened to the radome base. The motor is secured to the radome base using four aluminum motor supports and an aluminum motor mounting plate. As with the stationary bearing plate supports, the motor supports can be standoffs or ¼" diameter rods with two flat sides, 0.2" long #4-40 threaded section and a #4-40 threaded hole of depth ¼" on the other side; however the motor supports are 1.3" in length. The motor supports are screwed into the corresponding holes on the radome base. The motor mounting plate is screwed to the motor supports via four #4-40×¼" counter sunk screws. The motor is attached to the mounting plate by two M2x.4 cap screws of length about 6 mm.

Referring to FIGS. 1 and 2, the assembly also includes a positioning assembly. This positioning assembly includes a first part 180 attached to the first side of the rotating platform and rotatable with the rotating platform and a second part 181 attached to the radome base 111. The first part passes over the second part at a given point as the rotating platform 150 rotates relative to the radome base 111. Preferably, the first part 180 is a magnet, and the second part 181 is a Hall Effect sensor. The positioning system also includes an integral encoder, which is located inside the motor 170. The incremental encoder determines the position of the directional antenna relative to a pre-determined reference point.

The magnet 180 is screwed to the underside of the rotating platform 150 and when rotated, it passes directly above the Hall Effect sensor 181, which creates an active low output signal. The output signal is used to create the zero point upon which the motor encoder output will be relative to. Knowing the gear ratio and the position of the Hall Effect sensor 181, the angle of the antenna can be determined. The electronics and software that run and control the motor 170 and Hall Effect sensor 181 are located external to the assembly, with the signals being transmitted through the multiple pin connector 114.

The Hall effect sensor 181 snaps onto an aluminum Hall effect sensor mounting plate, which is attached to the radome base by a #2-56×¼" cap screw and a Hall effect sensor support. The Hall Effect sensor support, like the other supports, can be a standoff or a rod with a threaded rod screwed into one side. The Hall Effect sensor support is ¼" in diameter with two flat sides, has a 0.2" long #4-40 threaded section, a #4-40 tapped hole on the other side, and is 0.75" long. The Hall effect sensor support is screwed into the corresponding hole on the radome base and is secured to the Hall effect sensor mounting plate by a #4-40×1;4" countersunk screw. The Hall Effect sensor 181 contains three wires, which are all connected to the pin connector 114 on the radome base 111.

Referring to FIG. 1, the assembly includes a radome 190 attached to the radome base 111. The radome covers the stationary bearing plate 122 and the rotating platform 150 and defines a space 191 above the second side 154 of the rotating platform 150 sufficient to hold a directional antenna (not shown) or antenna assembly. In one embodiment, this space has a length 192 from the second side to the radome of less than about 5.5 inches. Suitable materials for the radome include materials that are transparent to the signals that are transmitted by or received by the directional assembly. The radome 190 is a composite piece used as a cover to protect the directional antenna from weather and water while allowing the transmission of signals. The radome 190 is pressure tested to ensure that it withstands submarine standards.

The antenna system can include any directional antenna that fits within the size constraints of the radome 190 and that utilizes a maximum of two coaxial connections 113. In one embodiment, the antenna system has a height of about 5.46 inches, an antenna SMA connection and a GPS SMA connection. In accordance with exemplary embodiments of the present invention, one directional antenna transmits and receives signals 360 degrees and is used inside a 4.75" submarine radome.

Advantages of the present invention over conventional systems include allowing a directional antenna to be used inside a smaller enclosure, i.e., the directional antenna fits inside a 5.3" outside diameter (OD) 193. In addition to being much smaller, the assembly of the present invention is also much lighter, which makes handling and installation easier.

The present invention is much more modular and adaptable in that almost any antenna system (within size constraints) can be placed on top of the stand with little modifications. It is also better than the systems utilized in current 4.75" submarine radomes because of the greater range. It focuses its power on a smaller area than the omni-directional antennas because it utilizes only one antenna rather than multiple directional antenna systems. Using one antenna means that power is not divided amongst multiple antennas, and since just one antenna can be used it can be larger, and thus more effective. Two other unique aspects of this invention are that it can pass two RF paths through the rotating platform, and its speed and position can be controlled and determined by the user.

In one embodiment, larger radomes are used by altering the dimensions of some of the parts. Larger radomes would mean that there is more internal space, and therefore larger antennas could be used. Larger antennas are typically more powerful than smaller antennas, and different sized antennas serve different purposes. The present invention could also be changed if there was more vertical space to work with, which would mean that the supports could be longer, the 90 degree attachments might not have to be used, and the Seacon and D G O'Brien connectors would not have to be modified. The rotating platform can also be changed so that it fits with different antennas by modifying the number of screws and screw positions and using pegs instead of screws, among other modifications.

In one embodiment, the present invention is made stronger or lighter by using different materials for any of the parts. Different motors and different gear heads may be used to provide different torques and operating speeds. A different model pin 26 connector, RF connectors, Hall Effect sensor, or magnet could also be used. Different coaxial cables or rotary joints could also be used such that the frequency of the antenna signals can be optimized. This assembly can also be altered by using more bearings or bearing surfaces to decrease friction. Precision components may also be incorporated in, such as anti-backlash gears and gear heads.

It will be understood that many additional changes in details, materials, steps, and arrangements of parts which have been described herein and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An antenna radome assembly comprising:

a radome base;

an annular stationary bearing plate attached to and spaced from the radome base;

a rotary joint comprising a fixed portion attached to the stationary bearing plate and a rotating portion extending through a central opening of the stationary bearing plate;

a rotating platform attached to and rotatable with the rotating portion of the rotary joint, the rotating platform comprising a circular recess extending into the rotating platform from a first side, the stationary bearing plate disposed completely within the circular recess; and an annular bearing assembly disposed within the circular recess between the rotating platform and the stationary bearing plate, wherein the bearing assembly is in contact with the rotating platform and the stationary bearing plate and the rotating platform rotates with respect to the stationary bearing plate and the radome base.

2. The assembly of claim 1, wherein:

the radome base comprises a disc having a circular cavity; and the assembly further comprises a pair of radome base co-axial cable connectors and a multiple pin connector attached to the radome base and disposed completely within the circular cavity such that the co-axial cable connectors and multiple pin connector do not extend above the circular cavity.

3. The assembly of claim 2, wherein:

the disc comprises a diameter of less than about 4.75 inches and a thickness of about 1.3 inches; and the circular cavity comprises a diameter of less than about 3.75 inches and a depth of about 0.75 inches.

4. The assembly of claim 2, wherein:

the rotatory joint comprises a dual channel rotary joint;

the rotating portion comprises a pair of connection terminals, one terminal for each channel, the connection terminals accessible from a second side of the rotating platform opposite the first side; and the fixed portion comprises a pair of rotary joint co-axial cable connectors in communication with the pair of connection terminals and the pair of radome base co-axial cable connectors.

5. The assembly of claim 1, wherein the stationary bearing plate comprises a diameter of about 3.5 inches.

6. The assembly of claim 1, wherein the assembly further comprises a plurality of stationary bearing plate supports attached to and extending between the stationary bearing plate and the radome base to space the stationary bearing plate from the radome base.

7. The assembly of claim 1, wherein:

the rotating portion of the rotary joint comprises a male portion of a two-part keyed connection; and the rotating platform comprises a keyhole disposed in the circular recess and extending through the rotating platform to a second side opposite the first side, the keyhole comprising a female portion of the two-part keyed connection, the male portion extending into the keyhole to attach the rotating portion to the rotating platform.

8. The assembly of claim 1, wherein the assembly further comprises a plurality of rotary joint supports attached to and extending between the stationary bearing plate and the fixed portion of the rotary joint such that the fixed portion extends towards the radome base and is spaced from the radome base.

9. The assembly of claim 1, wherein the bearing assembly comprises:

a diameter of less than about 2.75 inches; and a central hole having a diameter of about 2 inches.

10. The assembly of claim 1, wherein the bearing assembly comprises:

a first annular bearing surface in contact with the rotating platform;

a second annular bearing surface in contact with the stationary bearing plate; and a plurality of roller bearings disposed between the first annular bearing surface and the second annular bearing surface, the first annular bearing surface rotatable with respect to the second annular bearing surface over the plurality of roller bearings.

11. The assembly of claim 10, wherein:

the rotating platform comprises an internal annular groove disposed within and concentric with the circular recess, the first annular bearing surface disposed within the internal circular groove; and the stationary bearing plate comprises a concentric surface annular groove disposed opposite the internal annular groove, the second annular bearing surface disposed within the surface annular groove.

12. The assembly of claim 1, wherein the assembly further comprises an internal gear disposed in the circular recess such that the stationary bearing plate is spaced from the internal gear and is disposed between the internal gear and the rotating platform to secure the stationary bearing plate in the circular recess.

13. The assembly of claim 12, wherein the assembly further comprises:

a motor attached to the radome base and disposed between the radome base and the internal gear;

a pinion gear attached to and rotatable by the motor, the pinion gear engaging gear teeth disposed in the internal gear to rotate the rotating platform relative to the radome base and the stationary bearing plate.

14. The assembly of claim 1, wherein the assembly further comprises a positioning assembly, the position assembly comprising:

a first part attached to the first side of the rotating platform and rotatable with the rotating platform; and a second part attached to the radome base, the first part passing over the second part at a given point as the rotating platform rotates relative to the radome base.

15. The assembly of claim 14, wherein:

the first part comprises a magnet; and the second part comprises a Hall effect sensor.

16. The assembly of claim 1, wherein the assembly further comprises a radome attached to the radome base, the radome covering the stationary bearing plate and the rotating platform and defining a space between a second side of the rotating platform opposite the first side and the radome sufficient to hold a directional antenna.

17. The assembly of claim 16, wherein the space comprises a length from the second side to the radome of less than about 5.5 inches.

18. The assembly of claim 16, wherein:

the radome base comprises stainless steel;

the radome comprises a composite material transparent to signals transmitted or received by the directional antenna; and the stationary bearing plat and rotating platform comprise aluminum.

19. An antenna radome assembly comprising:

a radome base;

an annular stationary bearing plate attached to and spaced from the radome base;

a dual channel rotary joint comprising:

a fixed portion attached to the stationary bearing plate;

a rotating portion extending through a central opening of the stationary bearing plate; and a pair of connection terminals, one terminal for each channel, the connection terminals accessible from a second side of the rotating platform opposite the first side;

a rotating platform attached to and rotatable with the rotating portion of the dual channel rotary joint, the rotating platform comprising a circular recess extending into the rotating platform from a first side, the stationary bearing plate disposed completely within the circular recess;

an annular bearing assembly disposed within the circular recess between the rotating platform and the stationary bearing plate, wherein the bearing assembly is in contact with the rotating platform and the stationary bearing plate and the rotating platform rotates with respect to the stationary bearing plate and the radome base;

a radome attached to the radome base, the radome covering the stationary bearing plate and the rotating platform; and a directional antenna attached to the second side of the rotating platform opposite the first side and covered by the radome, the direction antenna comprising two co-axial connections, each co-axial connections attached to one of the connection terminals in the rotary joint.

20. The assembly of claim 19, wherein the directional antenna extends from the second side of the rotating platform a distance of less than 5.5 inches.

* * * * *